US006699354B2

(12) United States Patent
Schwenk et al.

(10) Patent No.: US 6,699,354 B2
(45) Date of Patent: Mar. 2, 2004

(54) METHOD AND A DEVICE FOR GLUING TOGETHER FLAT MATERIALS

(75) Inventors: Peter Schwenk, Vlotho (DE); Wilfried Dreischmeier, Vlotho (DE)

(73) Assignee: Schaetti AG, Wallisellen (CH)

( * ) Notice: Subject to any disclaimer, the term of this patent is extended or adjusted under 35 U.S.C. 154(b) by 316 days.

(21) Appl. No.: 09/864,922

(22) Filed: May 24, 2001

(65) Prior Publication Data

US 2002/0003028 A1 Jan. 10, 2002

(30) Foreign Application Priority Data

May 25, 2000 (DE) ..... 100 25 738

(51) Int. Cl.[7] ..... B30B 5/06

(52) U.S. Cl. ..... 156/311; 156/498; 156/555; 156/583.5

(58) Field of Search ..... 156/285, 311, 156/498, 555, 582, 583.1, 583.5

(56) References Cited

U.S. PATENT DOCUMENTS 4,997,507 A * 3/1991 Meyer ..... 156/286
6,227,271 B1 * 5/2001 Pourmand et al. ..... 156/498

FOREIGN PATENT DOCUMENTS

DE 69 11 638 U 11/1971
DE 21 23 870 A 11/1972
DE 17 56 949 B 3/1973
DE 37 01 564 C1 5/1988
DE 38 19 027 A1 12/1989
DE 196 14 741 C1 7/1997
DE 197 31 901 C2 6/1999

OTHER PUBLICATIONS

Magnetisierte Riemen fördern Bleche hängend. In: Industrieanzeiger 50/97, Dec. 9, 1997, S.44,45.

* cited by examiner

*Primary Examiner*—James Sells
(74) *Attorney, Agent, or Firm*—Weingarten, Schurgin, Gagnebin & Lebovici LLP

(57) ABSTRACT

The gluing together of flat materials between belt faces (21, 22), facing one another, of belt conveyors (15, 16) arranged over one another is effected usually with the application of heat and pressure. However there are pressure sensitive materials that with the gluing may only be impinged with a slight pressure. Here already the weight of the sagging belt face (21) of the upper belt conveyor may lead to an excessive pressure loading and a permanent deformation of the materials caused by way of this. The invention solves the mentioned problem in that the upper belt face (21) located above the materials to be glued is held up without contact, e.g., by means of suction nozzles or magnets. The sagging of the belt face (21) is alleviated by way of this and an undesirable high pressure loading of the materials to be glued is avoided. By way of the contactless holding-up of the belt face (21) the suction nozzles or magnets do not interfere.

31 Claims, 4 Drawing Sheets

METHOD AND A DEVICE FOR GLUING TOGETHER FLAT MATERIALS

FIELD OF THE INVENTION

The invention is in the field of processing of flat materials, in particular blanks and/or webs, of preferably textile materials, and relates to a method for gluing together such materials lying over one another. Furthermore the invention relates to devices for gluing together textile materials.

BACKGROUND OF THE INVENTION

The gluing together of flat materials, in particular of material blanks and/or material webs is effected usually on so-called laminating machines using the application of heat and pressure. The flat materials to be glued together, lying over one another, between two belt faces facing one another of belt conveyors arranged over one another, are transported along heating elements. At the same time the belts of the belt conveyor, which are directed towards one another, with the flat materials lying therebetween slide along the heating elements. Usually behind a heating station provided with the heating elements there is arranged a cooling station with cooling elements which cool the materials heated up for gluing together.

If such pressure sensitive materials, for example so-called distance weavings are glued together, at the same time only a slight pressure may be exerted onto these materials. The gluing is effected then essentially only by way of the effect of heat. If such pressure-sensitive materials are to be glued together on laminating machines, then alone it is not sufficient to bring the heating and/or cooling elements allocated to the belt conveyors lying over one another to such a distance that the belt faces, directed towards one another, of the belt conveyors lying over one another have a distance corresponding to the total thickness of the materials to be glued together. Alone the weight which the sagging upper belt face of the upper belt conveyor exerts onto the upper side of the materials to be glued leads to a pressure loading which has a negative effect on pressure-sensitive materials. Such pressure-sensitive materials may be pressed so much together and thus compacted by the weight of the sagging upper belt face that in particular on account of the heat acting on the materials with the gluing, the compacting is irreversible, thus permanent.

Proceeding from this it is the object of the invention to provide a method and device with which also pressure-sensitive flat materials may be glued together without problem, in particular without permanent deformations (compacting).

SUMMARY OF THE INVENTION

In the method according to the invention for gluing together flat materials lying over one another, the materials between belt faces directed to one another of belt conveyors arranged over one another are led past heating elements and in particular also cooling elements. The belt face at least of an upper belt conyeyor, said belt face being allocated to the upper side of the materials, is held up without contact.

By way of the fact that at least the upper belt face, allocated to the upper side of the materials, of at least one upper belt conveyor (of the heating and/or cooling station) is held up without contact, a sagging of the upper belt face is alleviated. The weight force of the upper belt face may by way of this no longer rest on the flat materials to be glued together. By way of this a pressing-together of pressure-sensitive materials on gluing is effectively avoided, so that also no permanent deformations may arise.

According to a preferred further embodiment of the method the upper-lying upper belt face is not only held up without contact but also lifted up without contact. By way of this an initial sagging of the upper belt face is first alleviated and subsequently the upper belt face is held without sagging.

The contactless holding-up and where appropriate lifting of the upper belt face may be effected in a different manner. Preferably this is effected magnetically or pneumatically by way of a vacuum. It is also conceivable to hold up and where appropriate lift up the upper belt face magnetically as well as pneumatically. The lifting-up of the upper belt face may be effected magnetically as well as pneumatically, whilst the upper belt face is held up only magnetically or only pneumatically.

According to a preferred embodiment of the method the upper belt face is lifted up until below the heating elements and/or cooling elements. This is effected preferably in a manner such that the upper belt face bears below the lower side of the heating and/or cooling elements and here is held, and specifically without a gap, by which means there is guaranteed a good thermal conduction of the heating and cooling energy. The lower sides of the heating and/or cooling elements at the same time serve for the lift limitation on lifting up the upper belt face of the upper lying belt conveyor and define the course of the held-up upper belt face below the heating and/or cooling elements.

The device according to the invention for gluing together flat materials lying over one another comprises belt conveyors arranged over one another as well as heating and/or cooling elements. Between belt faces, facing one another, of the belt conveyor the materials are transportable past the heating and/or cooling elements. To the heating and cooling elements which are allocated to the belt face, facing the upper side of the materials, of the upper belt conveyor, there are allocated means for holding up the upper belt face.

Accordingly the (upper) belt face, of the upper-lying belt conveyor, which comes into contact with the upper side of the materials to be joined, is provided with means which hold up the upper belt face at least without contact. These means are in turn allocated to the heating and/or cooling elements, wherein they may be an integral part of the heating and/or cooling elements. It is however also conceivable alternatively or additionally to arrange the means neighboring the heating and/or cooling elements. In each case the means hold the upper belt face without contact on or below the heating and/or cooling elements. The means at the same time ensure a bearing of the upper belt face on the heating and/or cooling elements, by which means a good energy transmission to the upper transport belt and from there to the flat materials to be glued is ensured and simultaneously a sagging of the belt face of the belt conveyor concerned which loads the upper side of the flat materials is alleviated.

According to one possible embodiment of the invention the means are designed as suction air producers or suction means. With this it is preferably the case of suction bores, suction nozzles and/or narrow suction slots. In particular suction bores are provided which open in flat grooves on the lower sides of the heating and/or cooling elements. By way of this a contactless lifting up of the upper belt face over preferably the whole width is possible, by which means reliably and with low air or pressure losses a vacuum may be maintained for the reliable contactless holding-up of the upper belt face.

In one advantageous embodiment of the invention the suction bores or nozzles are connected to a vacuum channel. With this preferably the suction nozzles or likewise and the vacuum channels are integrated in the respective heating and/or cooling element. Usefully (but without this limiting the invention), to each heating and/or cooling element there is allocated an elongate groove as well as a suction air channel. The suction nozzles produce a vacuum in the respective groove in the base wallings of the heating and/or cooling elements allocated to the upper belt conveyor. By way of this the upper belt face is held over a large surface below the lower side of the upper cooling and/or heating elements that serves for the delivery of energy.

An alternative means for the contactless holding and where appropriate lifting of the upper belt face is formed by way of magnets, preferably permanent magnets. Above all permanent magnets have the advantage that they are self-sufficient, by which means the upper belt face may be held up without the expense of energy.

With the use of magnets at least the conveyor belt of each upper belt conveyor is designed such that it may be attracted by the magnets. For this in the conveyor belt there may be incorporated or interlaced metallic particles or metallic threads. In this manner the conveyor belt concerned may simply be made magnetically effective, wherein the conveyor belt otherwise must be formed of non-conductive and thus magnetically non-effective materials.

The magnets are preferably arranged outside the heating and/or cooling magnets, preferably between neighboring heating and/or cooling elements. This arrangement is made such that the lower sides of the magnets lie roughly in a plane formed by the base surfaces of the heating elements and/or cooling elements. Preferably the lower sides of the magnets are arranged slightly over the plane spanned by the base wallings of the heating and/or cooling elements. By way of this the magnets do not obtain a direct contact with the conveyor belt, which means always between the magnet and the conveyor belt there exists a thin air gap. By way of this it is ensured that the belt face, of the corresponding belt conveyor, which is allocated to the flat materials to be glued always bears below the heating and/or cooling elements. By way of this a favorable energy transition from the heating and/or cooling elements to the belt face of the conveyor belt is ensured, wherein the air gap between the belt face of the conveyor belt and the magnet acts in an insulating manner so that the energy delivered by the heating and/or cooling elements is effectively conducted to the flat materials to be glued and not to the magnets which by way of this in the region of the heating zone do not significantly heat up and on account of this could lose their effectiveness.

A further device according to the invention for gluing together flat materials lying over one another comprises belt conveyors arranged over one another, as well as heating and/or cooling elements. Between belt faces, facing one another, of the belt conveyor, the materials are transportable past the heating and/or cooling elements. The upper heating and/or cooling elements allocated to the or to each upper belt conveyor are movable up and down by way of a lift means.

Accordingly the heating and/or cooling elements, preferably the heating and/or cooling elements arranged over the flat materials to be glued together, may be moved up and down by way of a lifting means. By way of the lifting means the heating and/or cooling elements may be moved up and down simply and exactly in an infinite manner for setting and maintaining an exact gap or conveyor gap between belt faces, facing one another, of the conveyor belts of the belt conveyors arranged over one another for transporting through the flat materials to be glued together.

Preferably all heating elements of the heating zone which are arranged over the flat materials to be glued together are arranged on a frame and by way of this may be commonly moved up and down by the lifting means. Likewise a frame is allocated to all upper-lying cooling elements of the cooling zone so that also these may be commonly moved up and down by way of a (separate) lever drive allocated to them. The common adjusting of all heating elements on the one hand and all cooling elements on the other hand ensures a simple and uniform adaptation of all heating and/or cooling elements to the thicknesses of the sheet formation to be glued in each case.

To the frame for holding all heating elements on the one hand and all cooling elements on the other hand there are allocated guide members, preferably upright lift columns. By way of this a uniform and tilt-free up and down movement of the frames and thus all heating elements or cooling elements allocated to them is ensured. According to a preferred embodiment of the invention to each frame there are allocated four lift columns that preferably are allocated to the corners of the rectangular, square frame. In this case the lift means allocated to each frame comprises four toggle levers, wherein in each case one toggle lever serves for the up and downward movement of a lift column. The four toggle levers of the frame for all heating elements or of the frame for all cooling elements can preferably be actuated commonly, and specifically synchronously. By way of this all four guide columns for adjusting the heating elements or cooling elements are moved up and down uniformly and together, by which means all heating elements or cooling elements over their whole length are adjustable up and down uniformly by the same height amount.

For the synchronization of the toggle levers below the lift columns of the frame of the heating elements or of the cooling elements there serve push rods that in each case connect two toggle levers. Four toggle levers are then allocated to two push rods. These two push rods are in turn connected to one another so that all four toggle levers are mechanically coupled to one another and can be actuated to the same extent via a single drive, in particular a lift means such as for example a pressure means cylinder. It is also conceivable to mechanically connect to one another two toggle levers which are not connected to one another, by way of push rods by another coupling member, in particular a coupling rod, so that on actuation of one toggle lever the other toggle lever is co-moved. The coupling may also be effected hydraulically or pneumatically.

The described lifting means, in particular the drive of this ensures with a simple construction a reliable uniform up and down movement of all heating elements or cooling elements.

BRIEF DESCRIPTION OF THE DRAWINGS

Preferred embodiment examples of the invention are hereinafter explained in more detail by way of the drawings. In these there are shown.

DESCRIPTION OF A PREFERRED EMBODIMENT

Figure 1:
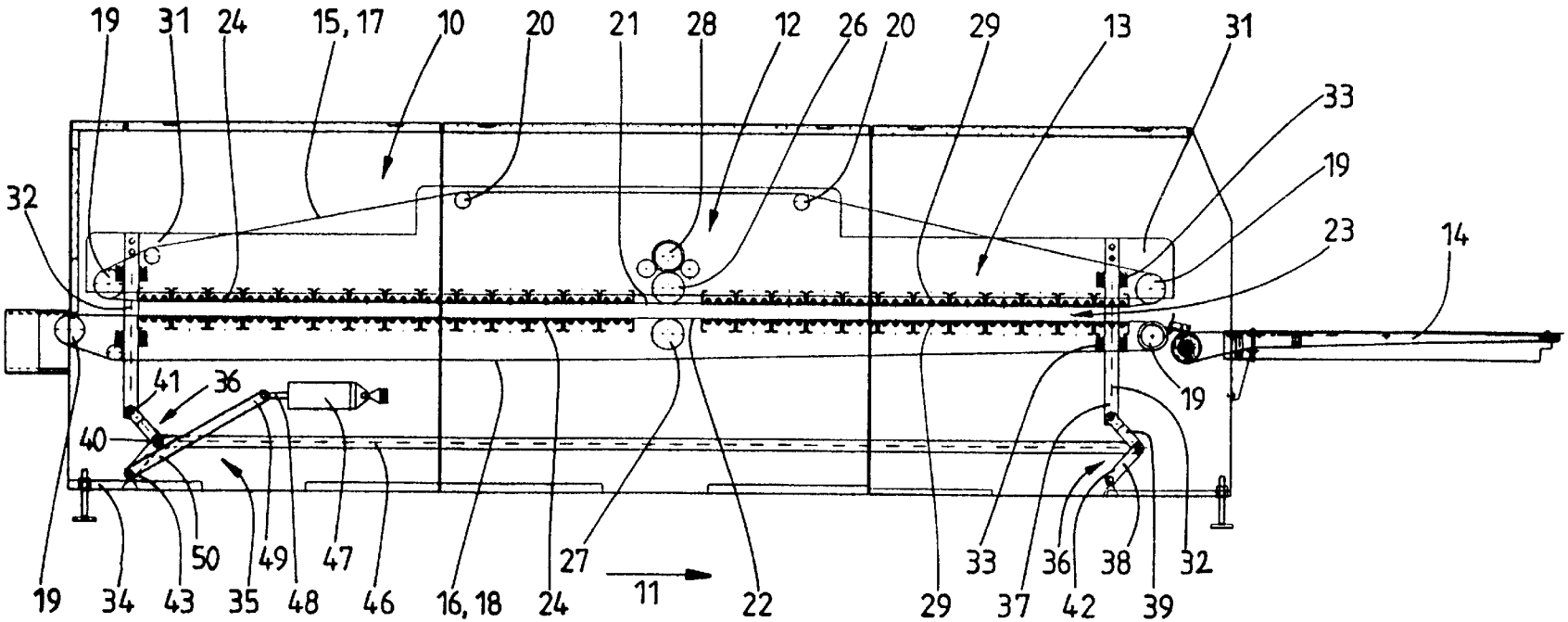
FIG. 1 a schematic side view of a device according to a first embodiment example of the invention, FIG. 2 an enlarged cross section through a heating profile, FIG. 3 a longitudinal section through the heating profile of FIG. 2, FIG. 4 a detail of a device according to a second embodiment example of the invention, specifically a cross section through several heating profiles arranged next to one another with magnets arranged therebetween, and FIG. 5 a horizontal section V—V through the device of FIG. 1 with a view of the lifting means.

The device that is shown completely in FIG. 1 serves for gluing together flat materials. The materials to be glued to one another are laid over one another and may be formed of webs and/or blanks. Preferably the device serves for gluing together flat textile parts, such as e.g. upper materials and inlays that are not shown in the figures. At least one of the textile pieces to be glued in each case is provided with an adhesive coating which is activated by heat. The gluing is accordingly effected by impinging the textile pieces to be glued with heat and at least a slight pressure.

The device shown here has at its disposal a heating station 10, whereupon in the working direction 11 of the device there follows a line pressure means 12 and therebehind a cooling station 13. The glued, flat textile pieces behind the cooling station 13 are led away out of the device by way of a delivery conveyor 14 to for example a stacking means.

In the device there are arranged two belt conveyors 15 and 16 lying over one another. Each belt conveyor 15 and 16 comprises a revolvingly drivable (endless) conveyor belt 17 and 18 respectively. The conveyor belt 17, 18 of each belt conveyor is led over various deflection drums 19 and support rollers 20. At least one deflection drum 19 of each belt conveyor 15 and 16 is drivable. Belt faces 21 and 22 of the conveyor belt 17 of the upper belt conveyor 15 and of the conveyor belt 18 of the lower belt conveyor 16, said belt faces facing one another, with the device shown here have a straight-lined horizontal course. The belt faces 20 and 21 run at a distance parallel to one another, by which means between the (upper) belt face 21 at the lower side of the upper belt conveyor 15 and the (lower) belt face 22 at the upper side of the lower belt conveyor 16 there is formed a conveyor gap 23 with a constant thickness over the whole length of the belt conveyor 15 and 16. The flat textile pieces to be glued together are transported through the device through the conveyor gap 23 between the belt faces 21 and 22.

To the upper-lying outer side, that is to say to the side of the upper belt face 21 which faces the space enclosed by the revolving conveyor belt 17 there are allocated heating elements in the region of the heating station 10. With this it is the case of elongate heating profiles 24 which are arranged at a slight distance next to one another in the working direction 11. With regard to their direction of longitudinal extension the elongate heating profiles 24 are aligned transversely to the working direction. Planar, horizontal base wallings 25 of all equally formed heating profiles at the same time lie in a common horizontal plane. Below the base wallings 25 of the heating profiles 24 allocated to the upper belt conveyor 15 there bears the upper belt face 21 with the upper outer side.

To the lower belt face 22 there are also allocated heating profiles that are arranged and formed exactly as the heating profiles 24 that are allocated to the upper belt face 21. The heating profiles 24 of the lower belt conveyor 16 with their base wallings likewise located in a horizontal plane bear from below on the outer side of the lower belt face 22. The allocated heating profiles 24 at opposite outer sides of the belt faces 21 and 22 limiting the conveyor gap 23 support the belt faces 21 and 22 of the conveyor belt 15 and 16 in the heating station 10 so that by way of the heating profiles 24 the conveyor gap 23 along the working direction is held at a predetermined width which is the same everywhere.

The line pressure means 12 consists of opposite pressure rollers 26 and 27 which as with the heating profiles are allocated to the outer sides of the belt faces 21 and 22 of the conveyor belts 17 and 18, said outer sides facing away from the conveyor gap 23. The pressure rollers 26 and 27 have a distance to one another which is such that also in the region of the line printing means 11 the inner sides, facing one another, of the belt faces 21 and 22, keep the conveyor gap 23 at a width which corresponds to the width of the conveyor gap 23 in the region of the heating station. The line pressure station 12 may be designed such as is known from DE 42 15 028 C2. In this case the upper print roller 26 comprises an elastic casing to which are allocated support rollers 28. The line pressure means 12 may where appropriate however also be formed of only two pressure rollers 26 and 7 with essentially rigid casings.

The cooling station 13 following the line pressure means 12 is basically designed as the heating station 10. Here to opposite outer sides of the belt faces 21 and 22 there are allocated cooling profiles 29 which are formed and arranged as the heating profiles. Thus the belt faces 21 and 22 also run along the base wallings 30, lying in parallel planes, of the cooling profiles. With this the cooling profiles 29 in the region of the cooling station 13 hold the belt faces 21 and 22 at a uniform, predetermined distance so that also here the conveyor gap 23 over its whole length has essentially the same width which preferably corresponds to the width of the conveyor gap 23 in the heating station 10 and the line pressure station 12. In the shown embodiment example the cooling station 13 differs from the heating station further in that the number of heating profiles 24 in the heating station 10 is larger than the number of cooling profiles 29 of the cooling station 13. Just the same the number of heating profiles 24 and of the cooling profiles 29 may however be equally large or more cooling profiles 29 than heating profiles 24 may be present. Inasmuch as this is concerned the invention is not limited to the shown embodiment example.

The upper belt conveyor 15 and the heating profiles 24 as well as the cooling profiles 29 allocated to the outer side of the belt face, but also the pressure rollers 26 and the support rollers 28 of the line pressure means 12 are commonly held in a frame 31 which in FIG. 1 is represented only by way of indication. By way of this the relative arrangement of the heating profiles 24 and of the cooling profiles 29 to the conveyor belt 17 of the upper belt conveyor 15 is fixed. The same applies to the upper part of the line pressure means 12. In each of the four corner regions of the rectangular frame 31 there is fastened a perpendicular lift column 32. The part of the device lying above the conveyor gap is thus held on four equally formed lift columns 32. Each lift column 32 in two guides 33 distanced from one another is mounted upwardly and downwardly movable in a frame housing shown only schematically in FIG. 1. The guides 33, arranged at a distance above one another, of each lift column 32 lie at different sides of the conveyor gap 23. All four lift columns 32 are movable up and down in the guides 33 simultaneously by way of a lever drive 35, by which means the frame 35 with the upper belt conveyor 15, the upper part of the line printing means 12 and the heating profiles 24 and cooling profiles 29 lying above the conveyor gap 29 are movable up and down as a unit. By way of this the width of the conveyor gap 23 may be changed in that by way of the up and down movement of the upper belt face 21 at the height-adjustable upper part of the device with respect to the stationary lower belt face 22 the distance between the belt faces 21 and 22 are uniformly and continuously changed. For this the lower part of the device with the lower belt conveyor 16, the lower part of the line printing means 12 and the heating profiles 24 and cooling profiles 29 allocated to the outer side of the lower belt face 22 are mounted on the frame housing 34 of the device in a stationary manner, specifically unchangeable with respect to height.

The lift means 35 comprises four toggle levers 36, wherein in each case one toggle lever 32 is allocated to a lower end 37 of each lift column 32. Each of the equally formed toggle levers 36 has at its disposal two equally long lever arms 38 and 39 that are connected to ends facing one another, in a link point 40. A free end 41 of the upper lever arm 38 is linkedly connected to the lower end 37 of the respective lift column 32. A free end 42 of the lower lever arm 39 is pivotably fastened about a fixed bearing point 43 on the frame housing of the device (FIG. 1).

Figure 5:
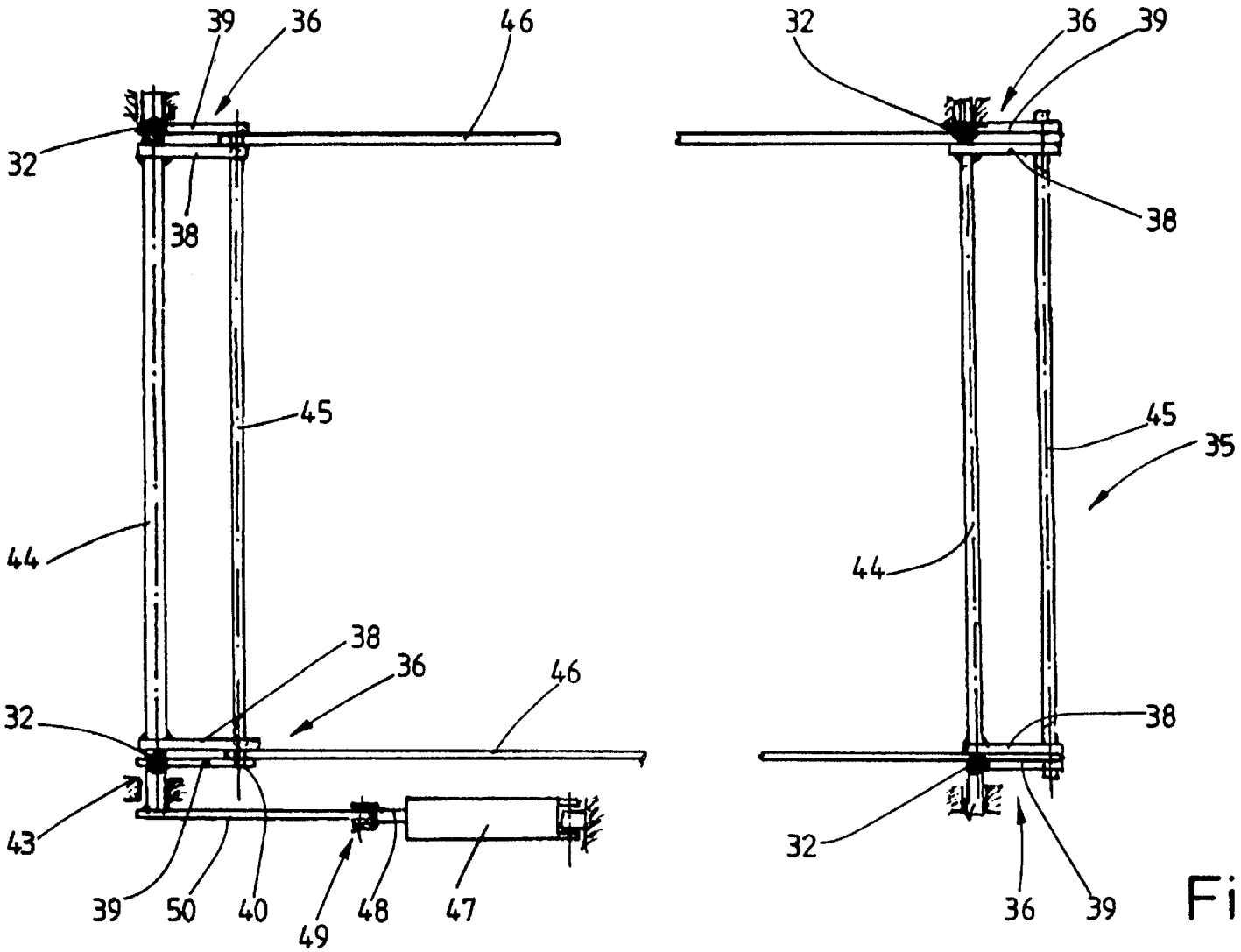

Two toggle levers 36 lying on each side of the device are at the link points 40 connected to one another by way of a push rod 46 (FIG. 1 and 5). By way of this the two toggle levers 36 on each side of the device can synchronously be actuated. Furthermore two opposite toggle levers 26 at two different sides of the device at the free ends 42, allocated to the bearing points 39, of the lower lever arms 39, are connected to one another by a coupling rod 44, an specifically in an unrotatable manner (FIG. 5). Likewise in the shown embodiment example in each case two toggle levers 36 lying opposite one another on different sides of the device are coupled to one another at the link points 40 by connection rods 45 (FIG. 5). The coupling rods 44, connection rods 45 and the push rods 46 connect the four toggle levers 36 to one unit, and specifically in a manner such that a single actuation in the region of a toggle lever 36 is sufficient in order to simultaneously and synchronously move all toggle levers 36. By way of this the lift means 35 is in the position of moving up and down all four lift columns 32 synchronously and by in each case an equal amount, by which means the upper part of the device, specifically the upper belt conveyor 15, the upper part of the line printing means 12 and the heating profiles 24 as well as cooling pofile 29 allocated to the upper belt conveyer 15 are uniformly movable up and down with respect to the stationary lower belt conveyor 16, for the symmetrical changing of the width of the conveyor gap 23 between the inner sides, facing one another, of the two parallel belt faces 21 and 22.

The single drive for adjusting the lift means 35, that is to say for the uniform actuation of all four toggle levers 36 is in the shown embodiment example designed as a pressure means cylinder 47. Alternatively there may also be provided a spindle drive, a rack drive or likewise. A movable piston rod 48 of the pressure means cylinder 47 is linkedly joined to a free end 49 of a tilt lever 50 that is connected in a rotationally fixed manner to one end of a coupling rod 44. On the coupling rod 44 free ends 42 of the lower lever arms 38 of two opposite toggle levers 36 are unrotatably fastened (FIG. 5). By way of actuation of the pressure means cylinder 47 the tilt lever 50 is pivoted and by way of this the coupling rod 44 is rotated. By way of this the lever arms 38 and 39 of the two toggle levers 36 is pivoted on that side of the lift means 35 that is allocated to the pressure means cylinder 47. By way of the connection of these two toggle levers 36 with the remaining two toggle levers 36 by way of the push rods 46, the lever arms 38 and 39 of these two toggle levers 36 are pivoted in opposite directions to the same extent and by way of this all four lift columns 32 are simultaneously moved up and down by the lift means 35.

To the heating profiles 24 and cooling profiles 29 lying above the upper belt face 21 there are allocated means for the contactless holding-up of the upper belt face 21 of the conveyor belt 17 of the upper belt conveyor 15.

Figure 2:
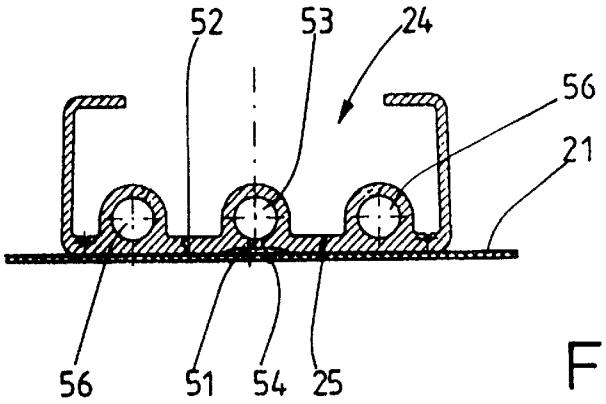
Figure 3:
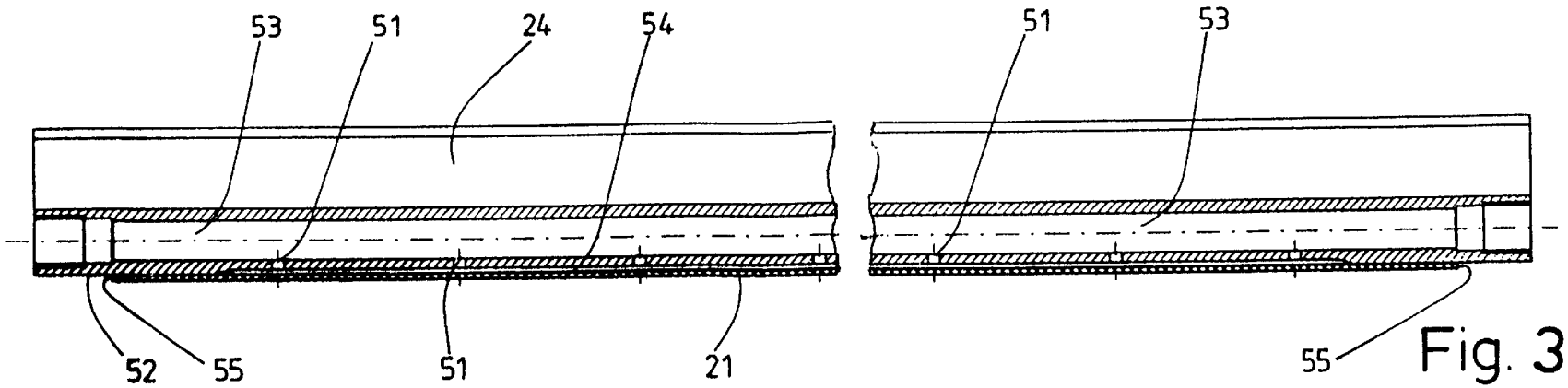

With the means shown in the FIGS. 1 to 3 it is the case of suction means. The suction means in the shown embodiment example comprise suction nozzles 51 (or also suction bores). The suction nozzles 51 in each case arranged in a row are open towards to base walling 25 of the heating profiles 24 and the base walling 30 of the cooling profiles 29. Open ends of the suction nozzles 51 facing the inside of the respective heating profile 24 or cooling profile 29 open into an elongate, cylindrical vacuum channel 53. At the opposite open ends of each vacuum channel 53 there are arranged air supply tubings or tubes that are not shown in the figures. By way of this the vacuum channels 53 are connected to the producer of the vacuum. Preferably each heating profile 24 and each cooling profile 29 is provided with a vacuum channel 53, wherein the vacuum channels 53 of all heating profiles 24 on the one hand and all cooling profiles 29 on the other hand are connected to the same vacuum supply tubings or the same vacuum supply tubes, and specifically in the manner of a parallel connection. By way of this it is ensured that in all vacuum channels 53 there may set in the same vacuum.

The suction nozzles 51 in the base wallings 25 of the heating profiles 24 and the base wallings 30 of the cooling profiles 29, said suction nozzles following one another in a middle row at preferably uniform distances, impinge a flat groove 54 in the middle of the lower side 25 of the respective base walling 25 and 30 respectively. The groove 54 by way of this forms a relatively large suction surface for suctioning a strip-shaped region of the outer side of the upper belt face 21 of the upper belt conveyor 15. The groove 54 is in its length designed such that it extends almost over the whole width of the upper belt face 21 of the conveyor belt 17 (FIG. 3), but at a small distance in front of the side edges 55 of the upper belt face 21 so that from the lower side 52 of the respective heating profile 24 or cooling profile 29 the groove 54 impinged with suctioning air is completely covered by the upper belt face 21 and by way of this no air may flow out through the groove 54, by which means the force with which the upper belt face 21 of the conveyor belt 17 is suctioned below the heating profiles 24 or the cooling profiles 29 could be reduced or lifted.

Each heating profile 52 on opposite sides of the vacuum channel 52 has at its disposal heating channels 56. The heating channels 56 are designed in the usual manner, and specifically in the same manner as the vacuum channels 53. Thus the vacuum channels 53 in the heating profiles 24 may be formed of a middle heating channel of usual heating profiles. In the same manner the cooling profiles 29 on opposite sides of the vacuum channel 53 have at their disposal cooling channels which are not shown in the figures and which are designed exactly as the vacuum channels 53.

By way of the fact that to each heating profile 24 and to each cooling profile 29 there is allocated a vacuum channel 53 with suction nozzles 51 and a groove 54 for increasing the suction surface of the upper belt face 21 of the upper belt conveyor 15, the upper belt face 21 at each heating profile 24 or each cooling profile 29 is held in a strip-shaped region, and specifically without contact by way of vacuum. The upper belt face 21 thus continuously bears on the lower side 52 of the heating profiles 24 and the cooling profiles 29. By way of this not only is a sagging, caused by gravity, of the upper belt face 21 alleviated and a conveyor gap 23 formed which over the whole working direction 11 has a uniform width, but much more the large-surfaced bearing of the upper belt face 21 below the heating profiles 24 and the cooling profiles 29 leads to the fact that no air gap is present between the lower sides 52 of the heating profiles 24 and cooling profiles 29 and the outer side of the upper belt face 21. By way of this a direct and effective energy transition from the heating profiles 24 or the cooling profiles 29 to the upper belt face 21 of the upper belt conveyor 15 is ensured, so that the heating and cooling energy from the heating profiles 24 and the cooling profiles 29 directly above the upper belt face 21 may be delivered to the flat textile formations to be glued together.

Preferably also a contactless, pneumatic lifting of the upper belt face 21 is effected by the vacuum produced below the heating profiles 24 and where appropriate also cooling profiles 29. The sagging upper belt face 21 is then by way of the vacuum lifted until below the lower sides 52 of the heating profiles 24 and the cooling profiles 29 which limit the lift path of the originally sagging upper belt face 21. After the upper belt face 21 has been lifted without contact by way of vacuum, it is held on the lower sides 52 of the heating profiles 24 and of the cooling profiles 29, and specifically at least for so long as pressure-sensitive materials, in particular flat textile objects, are to be glued together. By way of the upper belt face 2 held below the heating profiles 24 and the cooling profiles 29, the force weight of this does not load the materials to be glued, in particular textile sheet formations. These may be transported through the conveyor gap 23 between the belt faces 21 and 22 of the revolvingly driven conveyor belts 17 and 18 in the working direction 11, wherein only a slight pressure that may be set and metered in a directed manner is exerted onto the materials to be glued. The pressure is roughly equally large along the whole conveyor gap 23. In the cooling station 13 the pressure may be greater or less than in the heating station 10 or in the line printing means 12. Where appropriate it may also be sufficient only in the region of the heating station 10 to hold the upper belt face 21 below the heating profiles 24, thus only during the gluing together of pressure-sensitive materials not to let the weight of the upper belt face 21 rest on the surface of this since in the cooling station 13 by way of the cooling, the materials are no longer so pressure-sensitive.

It is also possible to support the lifting of the sagging upper belt face 21 in that for this, by way of the lift means 35 the upper belt conveyor 15 with the heating profiles 24 and the cooling profiles 29 is traversed downwards and a reduction of the conveyor gap 23 between the belt face 21 and 22 effected by way of this at least partly reduces the sagging of the upper belt face 21 by way of the bearing of the upper belt face 21 on the lower belt face 22. Then only by way of vacuum in a contactless manner, only a small part of the sagging of the upper belt face 21 needs to be lifted. This manner of proceeding is particularly suitable with those devices with which the sagging of the upper belt face 21 in the middle is so large that that it alone on account of the vacuum would no longer be suctionable below the heating profiles 24 or the cooling profiles 29. After the traversing together of the belt faces 21 and 22 and the contactless suctioning and lifting of the lower belt face 21 below the heating profiles 24 and the cooling profiles 29 then by way of the lift means 35 the upper belt conveyor 15, the heating profiles 24 and the cooling profiles 29 are again traversed upwards, and specifically so far until the belt faces 21 and 22 have such a distance which corresponds to the desired width of the conveyor gap 23.

Figure 4:
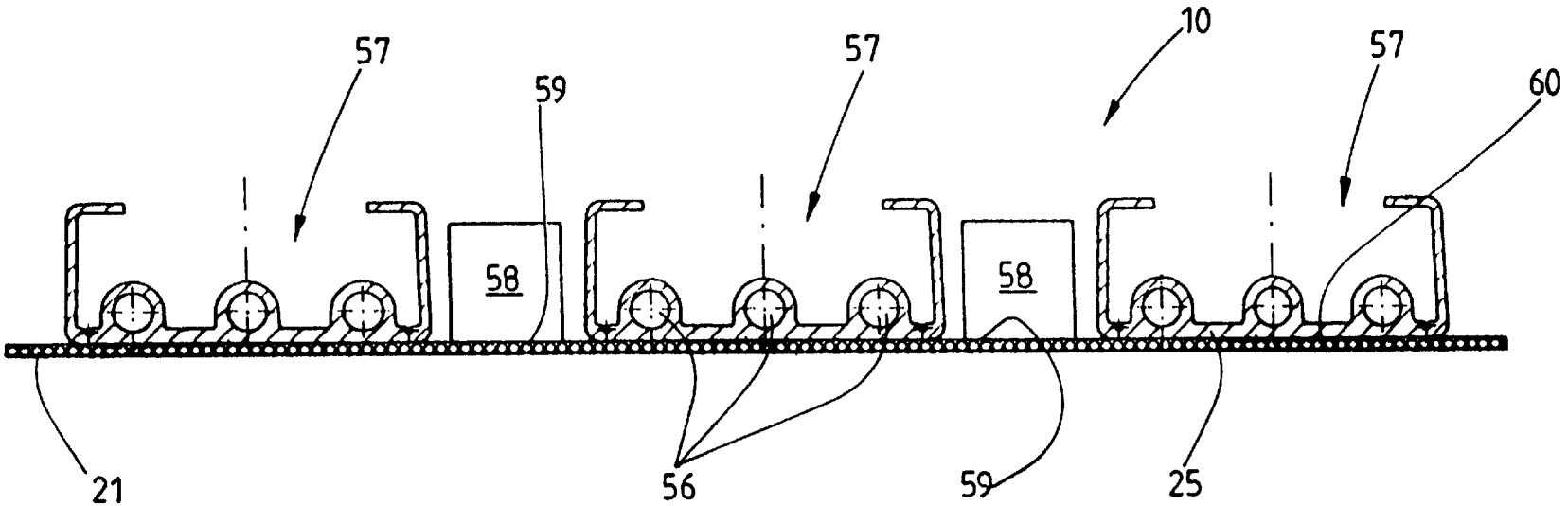

FIG. 4 shows an alternative formation of the device. With this the heating profiles 57 shown in FIG. 4 are designed in a manner known per se. However between the heating profiles 57 lying next to one another at a small distance there are arranged magnets 58. Preferably in the intermediate space between two neighboring heating profiles 57 there is located an elongate magnet 58 which only partly fills out this intermediate space and which extends roughly over the whole length of the conveyor belt 17. With the magnet 58 it is preferably the case of a permanent magnet.

The planar, horizontally running lower sides 59 of all magnets 58 are located in the plane formed by the undersides 60 of the upper belt face 21 when this is pulled up and is held below the heating profiles 57. Where appropriate the magnets 58 may also be arranged somewhat higher so that between the outer side of the upper belt face 21 of the conveyor belt 17 and the lower side 59 of the magnets 58 there remains a small insulating gap.

So that the conveyor belt, and specifically the upper belt face 21 of this may be held by the magnet 58 without contact below the heating profiles 47 and where appropriate lifted, the conveyor belt 17 is either formed of a material reacting with the magnet 58 or is made magnetically conductive, and specifically by way of embedding metallic particles and/or thin metallic wires in otherwise anti-magnetic material of the conveyor belt 17. The particles or wires consist of such material that is attracted by the magnets 58.

In the previously described manner a holding and where appropriate lifting of the upper belt face 21 in the region of the cooling station 13 may also be effected. Then between the cooling profiles not shown in FIG. 4 there are likewise arranged magnets 58.

Alternatively it is also conceivable to design the heating profiles 57 or the cooling profiles themselves as permanent magnets or electromagnets or to arrange the magnets in the hollow heating profiles 57 or cooling profiles, and specifically at those locations at which the base walling of the heating profiles or the cooling profiles are relatively thin.

Furthermore it is possible to hold the upper belt face 21 below the heating profiles 57, 24 and/or cooling profiles 29 without contact pneumatically as well as magnetically. Such a combination of different physically acting means is particularly suitable for the contactless lifting of the upper belt face 21 for alleviating the sagging. By way of the use of vacuum and magnet force a particularly strong and effective lifting of the upper belt face 21 is ensured. For the later contactless holding of the upper belt face 21 below the heating profiles 24, 57 and cooling profiles 29 the magnets 58 alone may be sufficient (or also only the vacuum means). For holding then the vacuum supply for producing a suction pressure may be set out of operation.

Numerous other embodiments may be envisaged, without departing from the spirit and scope of the invention.

What is claimed is:

1. A method for gluing together flat materials, in particular blanks and/or webs, lying over one another, of preferably textile materials, wherein the materials between belt faces directed to one another of belt conveyors arranged over one another are led past heating elements and in particular also cooling elements, wherein the belt face at least of an upper belt conyeyor, said belt face being allocated to the upper side of the materials, is held up without contact.

2. The method according to claim 1, wherein the belt face is lifted and held up in a contactless manner.

3. The method according to claim 1, wherein the belt face is held up and/or lifted magnetically.

4. The method according to claim 1, wherein the belt face is held up and/or lifted pneumatically, in particular by suctioning.

5. The method according to claim 1, wherein the belt face is held below the heating elements and/or cooling elements arranged above the materials to be glued together.

6. The method according to claim 1, wherein the belt face is lifted until below the upper heating and/or cooling elements.

7. The method according to claim 1, wherein the lifting up of the belt face is supported by a height adjustment of the heating and/or cooling elements.

8. A device for gluing together flat materials, in particular blanks and/or webs, lying over one another, of preferably textile materials, with belt conveyors arranged over one another as well as heating and/or cooling elements, wherein between belt faces, facing one another, of the belt conveyor the materials are transportable past the heating and/or cooling elements, wherein to the heating and cooling elements which are allocated to the belt face, facing the upper side of the materials, of the upper belt conveyor, there are allocated means for holding up the upper belt face.

9. The device according to claim 8, wherein the means are designed as pneumatic suction means.

10. The device according to claim 9, wherein the pneumatic suction means are designed as narrow suction slots and/or as suction bores or suction nozzles preferably arranged in rows.

11. The device according to claim 10, wherein the suction nozzles open into preferably flat grooves in the lower sides of the heating elements and/or cooling elements.

12. The device according to claim 10, wherein the suction nozzles of each heating element and/or cooling element may be fed with suction air via a vacuum channel, wherein the suction nozzles are preferably arranged between the respective vacuum channel and the groove on the lower side of each heating element and/or cooling element.

13. The device according to claim 9, wherein the suction means are integrated into the heating and/or cooling elements, preferably each heating and/or cooling element comprises a vacuum channel, suction nozzles and a flat groove.

14. The device according to claim 13, wherein the flat grooves in the lower sides of the heating and cooling elements extend over a large part of the width of the conveyor belt, preferably end at a slight distance on opposite side edges of the conveyor belt.

15. The device according to claim 8, wherein the means at least for holding up the upper belt face are designed as magnets, preferably permanent magnets.

16. The device according to claim 15, wherein the conveyor belt of the or of each upper belt conveyor is attractable by the magnet.

17. The device according to claim 15, wherein the magnets, in particular permanent magnets, are arranged between neighboring upper heating and/or cooling elements in the region of the or of each belt conveyor.

18. The device according to claim 15, wherein the lower sides of the magnets are arranged roughly in the plane of the lower sides of the heating and/or cooling elements, preferably the lower sides of the magnets lie slightly above the plane of the lower sides of the heating and/or cooling elements.

19. The device according to claim 8, wherein the means, in particular suction means and/or magnets, are movable up and down synchronously with the heating and/or cooling elements, in particular with the upper heating and/or cooling elements.

20. A device for gluing together flat materials, in particular blanks and/or webs, lying over one another, of preferably textile materials, with belt conveyors arranged over one another, as well as heating and/or cooling elements, wherein between belt faces, facing one another, of the belt conveyor, the materials are transportable past the heating and/or cooling elements, wherein the upper heating and/or cooling elements allocated to the or to each upper belt conveyor are movable up and down by way of a lift means.

21. The device according to claim 20, wherein at least the upper heating elements commonly are movable up and down by way of their own lift means.

22. The device according to claim 20, wherein the upper heating and cooling elements are commonly movable up and down by way of a lift means.

23. The device according to claim 20, wherein all heating elements and/or all cooling elements are arranged on a common frame and to the frame in each case there are allocated preferably four vertical lift columns, wherein the lift columns are commonly movable up and down, in particular to the same extent, by the lift means.

24. The device according to claim 23, wherein the respective lift means engages on the lower ends of the lift columns, preferably all four lift columns of the frame, for all heating elements and/or all cooling elements.

25. The device according to claim 24, wherein the lift means comprises a toggle lever at the lower end of each lift column.

26. The device according to claim 25, wherein the toggle levers in each case of two lift columns are connected by a push rod.

27. The device according to claim 26, wherein the two different pairs of toggle levers connected by way of in each case one push rod are connected amongst one another.

28. The device according to claim 25, wherein a toggle lever of one pair of toggle levers is connected to an opposite toggle lever of another pair of toggle levers.

29. The device according to claim 25, wherein all four toggle levers of each lift means are actuatable by way of a single lift means, preferably a pressure means cylinder.

30. The device according to claim 25, wherein the lift means is allocated to a toggle lever.

31. The device according to claim 30, wherein the lift means is allocated to a free end of a toggle lever, wherein the toggle lever is unrotatably connected to a coupling rod, which in turn connects a toggle lever of each pair of toggle levers.

* * * * *